US009757974B2

(12) United States Patent
Kalwa

(10) Patent No.: US 9,757,974 B2
(45) Date of Patent: Sep. 12, 2017

(54) METHOD FOR PRODUCING A MATERIAL PLATE PROVIDED WITH A DECORATIVE LAYER

(71) Applicant: Flooring Technologies Ltd., Pieta (MT)

(72) Inventor: Norbert Kalwa, Horn-Bad Meinberg (DE)

(73) Assignee: Flooring Technologies Ltd., Kalkara (MT)

( * ) Notice: Subject to any disclaimer, the term of this patent is extended or adjusted under 35 U.S.C. 154(b) by 3 days.

(21) Appl. No.: 14/651,280

(22) PCT Filed: Dec. 12, 2013

(86) PCT No.: PCT/EP2013/076366
§ 371 (c)(1),
(2) Date: Jun. 11, 2015

(87) PCT Pub. No.: WO2014/090939
PCT Pub. Date: Jun. 19, 2014

(65) Prior Publication Data

US 2015/0314639 A1 Nov. 5, 2015

(30) Foreign Application Priority Data

Dec. 12, 2012 (EP) ..... 12196717

(51) Int. Cl.
*B44C 5/04* (2006.01)
*E04F 15/00* (2006.01)

(52) U.S. Cl.
CPC ..... *B44C 5/0469* (2013.01); *E04F 15/00* (2013.01)

(58) Field of Classification Search
CPC ..... B44C 1/24; B44C 5/043; B44C 5/0469; B05D 3/002; B05D 2203/22; B05D 5/12; B05D 5/062; B32B 21/08; B32B 2272/00; B32B 27/42; B32B 29/00; B32B 27/00; B32B 2260/028; B32B 2260/046; B32B 2451/00; B32B 27/04; B32B 38/08; B32B 15/08; B32B 5/28; E04F 15/00
See application file for complete search history.

(56) References Cited

U.S. PATENT DOCUMENTS

| | | | | |
|---|---|---|---|---|
| 6,551,694 | B1 * | 4/2003 | Imamichi | B32B 29/06 428/195.1 |
| 2010/0255248 | A1 * | 10/2010 | Steindl | B32B 33/00 428/113 |
| 2011/0120634 | A1 | 5/2011 | Thiers et al. | |

FOREIGN PATENT DOCUMENTS

| | | | |
|---|---|---|---|
| DE | 102005036541 | A1 | 2/2007 |
| DE | 102007013133 | A1 | 9/2008 |
| DE | 102007026170 | A1 | 12/2008 |
| EP | 2230095 | A1 | 9/2010 |
| EP | 1977909 | B1 | 11/2010 |
| WO | 2009153680 | A2 | 12/2009 |
| WO | WO 2009153680 | A2 * | 12/2009 |
| WO | 2012126816 | A1 | 9/2012 |

OTHER PUBLICATIONS

Machine translation of EP 2230095 A1.*

* cited by examiner

*Primary Examiner* — Vishal I Patel
(74) *Attorney, Agent, or Firm* — The Webb Law Firm

(57) ABSTRACT

Provided is a method for producing a wood based board including a support board and a decor paper disposed on the support board. The method includes the steps of a) providing a support board, b) applying at least one layer of at least one impregnating resin onto the at least one side of the support board, c) providing the decor paper, d) applying at least one resin as impregnating agent onto the side of the decor paper opposite from the decor, and e) placing the decor paper with the side impregnated opposite from the decor onto the side of the support board provided with the impregnating resin.

19 Claims, No Drawings

METHOD FOR PRODUCING A MATERIAL PLATE PROVIDED WITH A DECORATIVE LAYER

CROSS-REFERENCE TO RELATED APPLICATIONS

This application is the United States national phase of International Application No. PCT/EP2013/076366 filed Dec. 12, 2013, and claims priority to European Patent Application No. 12196717.8 filed Dec. 12, 2012, the disclosures of which are hereby incorporated in their entirety by reference.

BACKGROUND OF THE INVENTION

Field of the Invention

The present invention relates to a method for producing a wood-based board provided with a decor layer made of a decor paper.

Description of Related Art

When producing boards, in particular in form of laminated boards, typically different papers such as decor paper, overlays, backing papers, underlays and such are impregnated first in an impregnation line with a duroplastic resin, which contains usually water as solvent. The different papers are than subsequently dried to a defined humidity of about 5-7 wt %. Such completely impregnated papers are than pressed onto the wood-based boards in a press in a short cycle process for obtaining laminate boards.

Different methods are applied for the continuous processing of decor papers for producing the different products. While relative simple varnished finish films, i.e. glued papers with small amount of glue are used for furniture applications, papers or impregnates with higher amount of resin are used for flooring applications due to the higher mechanical stress when used, which guarantee a higher crack resistance. Thereby the continuous process has substantial advantages compared to the discontinuous process as for instance in the short cycle press regarding the processing. It is more efficient, there are less material losses due to breakage and the facilities are mechanically less elaborate.

An aggravating problem is that in the last years the demanded product quality poses higher demands to the manufacturing processes. This is valid for the complete value added chain in the production of laminate floors. In the impregnation process, wherein the different papers, which are used for the laminate floor production, are impregnated with a duroplastic resin, significant problems occur due to the swelling of the paper. This relates in particular to the decor papers. They change their dimensions due to water absorption in longitudinal and cross direction. If the decor layer is now subsequently pressed onto the wood-based board, the resin used as an impregnating means melts and connects the decor paper to the core of the board. It is however essential for the further processing of the wood based board provided with a complete impregnated decor paper layer that the swelling degree of the decor layer is considered in order to obtain a correlation of the decor to the format of the finished boards (length and width rapport) as well as possible. This is however very elaborate and often not possible due to the greatly varying swellings of the decor paper in length and width during the impregnating process.

In order to reduce or avoid said swelling problem of a complete impregnated decor paper layer the use of dry decor papers was suggested in the past. For example in DE 10

2007 026 170 A1 no impregnated or higher resinated paper is used, but rather a raw paper that is glued onto the carrier using a water containing glue. In EP 1 977 909 B1 it is also provided to place the dry decor paper onto a melamine resin layer applied to the upper side of a support board, to cover said paper subsequently with a melamine resin layer and to finally press said structure. Hereby the problem of paper swelling is minimized by using the dry paper.

The variants described at last have however problems during processing when contacting the aqueous resins due to swelling processes in the paper, which can provide wrinkle formation. In order to avoid this the guidance and fixation of the paper web has to be designed very exact. Furthermore, the process can cause swellings in the cover layer of the wood based board due to the significant amounts of water, which are applied onto the support by the glue. This causes a deterioration of the technological properties of the cover layer (cover layer surface soundness). This effect is the more severe the longer the water is exposed to the board before further refinement (system downtime, program change and so on).

The described variants seem to solve the problem of the paper growth by swelling on a first glance. However, a new problem arises, when decors are processed once by using dry decor paper webs and once according to the standard process using completely impregnated decor paper webs. As already described above the impregnated papers are swollen during the impregnating process and have thus a different length and width as the dried papers glued directly onto the board. If based thereon the same products are now produced in the same format again problems with the length and with rapport can occur.

Impregnated papers are typically pressed on a support by means of the short cycle press technology in a press. This short cycle technology has however also some disadvantages. Firstly, the impregnated paper sheets are relatively brittle and can be torn or destroyed when processing. Secondly, the production of the sheets is also susceptible for waist. Altogether said methods are also relatively expensive since a total of three papers are used.

Starting from this technological background a method shall be developed which reduces or eliminates said disadvantages of the above described methods.

SUMMARY OF THE INVENTION

This object is solved by providing a method for producing a wood based board consisting of a support board and a décor paper disposed on the support board, wherein the decor paper has a décor on at least one side, preferably the upper side or visible side as described herein.

The method comprises the following steps:

a) providing the support board,
b) applying at least one layer of at least one impregnating resin to the at least one side of the support board, preferably to the upper side of the support board, and
c) providing the decor paper,
d) applying at least one resin as impregnating agent to the side of the decor paper opposite from the decor, and
e) placing the decor paper with the impregnated side opposite from the decor onto the side of the support board provided with the impregnating resin.

The present method is thus characterized in that solely one side, preferably the lower side of the decorative paper or decor paper which is not printed is impregnated with a resin. At present thus a décor paper is used when producing a board which is only partially impregnated, wherein preferably the complete area of a non-printed lower side of the décor paper, i.e. the side of the decor paper opposing the visible side, is evenly provided with the impregnating resin. In order to achieve this an aqueous resin as impregnating resin is applied on the back side, i.e. on the side of the decor paper not provided with a decor. The decor of the decorative paper can be applied by gravure printing and/or digital printing.

In an embodiment the amount of resin applied to the side of the decor paper opposite from the decor is between 30 and 70 wt %, preferably between 40 and 60 wt %, in particular preferably 50 wt % based on the paper weight of the decor paper. Thus for example 50 to 100 g, preferably 70 g impregnating resin is applied per $m^2$ decor paper (paper weight: 70 g/$m^2$, solid content resin: 50 wt %).

In contrast in case of a conventional completely impregnated décor paper a resin amount of 90-110 wt % based on the paper weight of the décor paper is applied onto the same, wherein the amount of the resin hereby typically orientates itself in respect to the overlay impregnation.

In different variants of the present method it was noticed that decor papers impregnated on the side opposite to the decor can have a swelling in the length in a range between 0.2-0.4% and in the width in a range between 0.5-0.9%. In comparison, the values of completely impregnated papers are in the length in a range of 0.4 to 0.9% and in the width at 1.2-1.8%.

The use of a solely partially, one-sided impregnated decor paper has multiple advantages in contrast to the use of a complete impregnated decor paper as well as in contrast to the use of a dry decor paper.

Thus, in comparison to a complete impregnated decor paper the amount of used impregnating resin is drastically reduced at this value added stage. This causes a drastically reduced capital binding in the complete process. Also the drying process is reduced due to the reduced amount of impregnating agent in comparison to completely impregnated decor papers, since less resin has to be heated up and less water has to be evaporated during the impregnating process such that a higher production speed and thus an energy reduction in the production process is possible.

In comparison to the use of dry decor paper, a pre-swelling of the decor paper occurs such that the disadvantages connected to the swelling process when using dry decor paper during the process of the boards is avoided.

Furthermore, the one-sided impregnated décor paper has a better adhesion and a more rapid sticking to the support board in respect to a dry décor paper. Thus, the liquid resin or impregnating resin applied to the at least one side of the support board causes a solubilization of the pre-dried impregnating agent on the back side of the decor paper wherein a faster sticking of the décor paper on the support board is possible. With other words: the impregnating resin activates the impregnation and causes a rapid sticking and a slip tight connection between the support board and decor paper. An additional glue application is not required.

It is also preferred if the decor paper impregnated on the side opposite from the decor is dried to a moisture content of 3-10 wt %, preferably 5-7 wt %, especially preferably of 6 wt %. The drying can be done in a convection dryer or by means of near infrared (NIR).

In a variant of the present method the décor paper impregnated one-sided on its lower side and preferably on its complete area is rolled up. This allows a storage of the partially impregnated decor paper for a further application.

It is furthermore also possible that the décor paper impregnated on the side opposite from the décor is placed or pressed immediately or immediately following the impregnation onto the support board. Hereby the placement or pressing of the partially impregnated decor paper on the support board occurs which was previously provided with the liquid resin or impregnating resin.

A melamine formaldehyde, a melamine urea resin or an acrylate resin with a solid content between 30-70 wt %, preferably 40-60 wt %, in particular with a solid content of 50 wt % is preferably used as impregnating resin.

As impregnating resins, which are to be applied on the at least one side of the support board, a melamine formaldehyde resin, a melamine phenol formaldehyde resin, a melamine urea resin or an acrylate resin with a solid content between 55-80 wt %, preferably 60-70 wt %, in particular preferably of 60 wt % are applied. Accordingly the viscosity of the liquid resin to be applied to the support board is higher than the resin used as impregnating agent.

The amount of the impregnating resin to be applied onto the support board is 30 to 70 g, preferably 50 g per $m^2$ support board. The impregnating resin contains the usual additives as harder, wetting agent, defoamer and so on.

The impregnating resin to be applied onto the support board is applied by means of a drum and is dried after the application in order to evaporate a part of the water. However, the drying takes place only insofar that the resin still contains sufficient stickiness for fixation of the partially impregnated decor paper.

After application and optionally interim drying of the partially impregnated decor paper on the support board a further finishing of the surface can be carried out.

Thus, in a further embodiment of the present method in a further step f) at least on further layer of a resin is applied onto the upper side or visible side of the décor paper, i.e. the side of the decorative paper provided with the décor, which is not impregnated, after applying the décor paper impregnated on the side opposite from the décor onto the support board and optional an interim drying.

This further layer to be applied can consist solely of a resin or it is also possible to use a mixture containing the resin, natural and/or synthetic fibers, abrasion-resistant particles and optionally further additives.

The liquid or impregnating resin, as for instance a melamine resin of the above-mentioned kind, to be applied to the decor paper has a solid content of 60 to 70 wt %, in particular of 60 wt %. The formulation of impregnating resin, fiber and abrasion resistant particles is preferably applied in an amount of 50 to 80 g solid resin/square meter. This mixture applied onto the upper side of the decor paper can then be dried in a dryer to a defined residual moisture. The drying can also take place here in a convection dryer or by near infrared.

This method can be repeated multiple times in further application devices and dryers, wherein in a variant abrasion resistant particles in a resin formulation are in the first two application devices. In another variant only an application of resin with corundum is provided.

According to these possible variants, the application of a further mixture of impregnating resin, fibers, glass beads and additives can occur onto the first mixture of liquid resin, natural and/or synthetic resins, abrasion resistant particles and optionally further additives. In total, two to four further applications of said mixture can be carried out such that hereby the formation of a so called liquid overlay occurs.

It is, however, also possible and of an advantage, if at least one overlay, in particular a resin impregnated overlay (overlay impregnate) is applied onto said first application of the mixture of liquid resin or liquid resin, fibers, particles and optionally further additives.

According to a further embodiment it is also possible to apply in an alternative further step f1) at least one overlay, in particular a resin impregnated overlay after the placement of the decor paper impregnated on the side opposite to the decor onto the support board.

The natural and/or synthetic fibers are preferably selected from a group of bleached cellulose fibers or organic polymer fibers.

The abrasion resistant particles are preferably selected from the group comprising aluminum oxide, corundum, boron carbide, silicon dioxide, silicon carbide and glass beads, whereby corundum and glass beads are in particular preferred.

It is also possible to add at least one color pigment selected from a group comprising titanium dioxide, zinc oxide, iron oxide pigments or metal effect pigments to the mixture. The variability and possibilities are thereby not limited.

As already mentioned above, it is also possible to add further additives to the mixture of liquid resin, fibers and abrasion resistant particles. Thereby, this at least one additive can be selected from a group comprising conductive substances, fire retardants, luminescent compounds and metals. Carbon fibers and nanoparticles, in particular carbon nanotubes are thereby mentioned as conductive substances. Typical flame retardants are selected from the group comprising phosphate, borate, in particular ammonium polyphosphate, tris(tri-bromneopentyl) phosphate, zinc borate or boric acid complexes of polyvalent alcohols. Zinc sulfite and earth alkali aluminate are in particular mentioned as fluorescent and phosphorescent compounds.

In a further step g) the layer system composed of support board, decor paper and optionally further resin layers is preferably compressed. The compression of the layer system takes place preferably in a continuous press. When compressing the layer system a surface structure above the decor, optionally in correspondence to the decor in form of a so called "emboss in register" is formed.

In a further variant of the method, at least one backing paper is applied to the opposite side of the support board not provided with the decor paper.

In a further embodiment the support board consists of wood-based material, plastic or a wood-based material plastic mixture, wherein in particular chipboard, medium density fiber board (MDF), high density fiber board (HDF), oriented strand board (OSB) or plywood board are preferred, or also a cement fiber board and/or a gypsum fiber board can be used.

The board coated by the means of the present method is subsequently transferred together with a backing paper to a short cycle press and the resins are hardened at high pressure and high temperature, wherein as already mentioned above in a variant the placement of a protective overlay in form of an overlay impregnate is possible. The latter one can also be done for obtaining an increased abrasion resistance. This can be, in particular, required when using the floor panels in highly stressed objects.

The boards obtained by the present method are preferably used as laminate panels.

Altogether, the present method has several advantages: The partial impregnation or one-sided impregnation of the decorative paper causes a lower capital binding on this value adding chain. The partially impregnated paper is already pre-swollen such that length and width rapport problems are reduced which typically occur when using dry decor paper. Furthermore, the roll-to-roll processing is considerably cheaper and the flexibility of the production increases.

A further advantage of the present method is its high variability, which orients itself at the later use of the products. Beside the already mentioned embodiments it is possible to install between the singular application processes also printing devices, to incorporate effect pigments into the resin formulations, to use additives for improving the product properties (as for instance conductivity, impact sounds and so on) and to integrate other functional layers as for instance pressure sensitive layers.

DETAILED DESCRIPTION OF THE INVENTION

The present invention is subsequently explained and described by means of multiple examples for a better understanding.

Example 1

A print basis paper (paper weight 8 g/m$^2$) is unrolled from an unrolling device and is printed in gravure printing and/or digital printing method and is then impregnated in an impregnating device on the backside with a melamine resin. Thereby, about 50 g melamine resins/m$^2$ with a solid content of about 50% is applied.

The paper is subsequently dried in a convection dryer or by NIR (Near Infrared) to a moisture of about 6 wt %.

Subsequently, the impregnate is pressed in a continuous working press onto a board pre-coated with melamine resin (applied amount 50 g melamine resin/m$^2$, solid content of impregnating resin 60 wt %). The melamine resin being on the board contains the usual additives (hardener, wetting agent, defoamer and so on) and was pre-dried after the application with the drum by convection or an IR.

A mixture of melamine resin (solid content impregnating resin 60 wt %), cellulose and corundum in an amount of 50 to 80 g impregnating resins/m$^2$ depending on the desired abrasion class is applied subsequently onto the decor paper also by drum application. The mixture is dried in a convection dryer or by near infrared.

Subsequently, further resin applications (between 2 and 4) take place, whereby a mixture of melamine resin, cellulose and glass beads is applied. The solid content of the fleet is thereby also at about 60%. The drying is realized as described above.

At the end of this process the coating is dried to a residual moisture of about 6 wt %. Subsequently, the coating is hardened in a short cycle press or in a continuously working press (p=30 bar, T=200° C.), whereby on the backside of the board either resin impregnated backing paper or a resin also applied in the liquid process and pre-dried is exposed on the backside of the board.

Example 2

A decor paper (paper weight: 80 g/m$^2$) is unrolled from an unroller device and is impregnated on the back side with an urea resin in an impregnating device. Thereby about 50 g urea resin/m$^2$ are applied (solid content: 50 wt %).

The paper is dried subsequently in a convection dryer or by NIR to a moisture of about 6%.

Than the one-sided impregnated paper is pressed in a continues working press onto a board pre-coated with a melamine resin (applied amount 50 g melamine resin/m$^2$, solid content 60 wt %). The melamine resin being on the board contains the usual additives (hardener, wetting agent, defoamer and so on) and was pre-dried after the application with a drum by convection or NIR.

A mixture of melamine resin (solid content: 60 wt %), cellulose and corundum in an amount of 50-80 g impregnating resin/$m^2$ pending on the desired abrasion class is applied onto the decor paper subsequently also by drum application. The mixture is dried in a convection dryer or by near infrared. The moisture of the coating is about 6 wt % after the drying process.

Subsequently a resin impregnated protection overlay is placed (paper grammage: 25 g/$m^2$, final weight 100 g/$m^2$). Subsequently the coating is hardened in a short cycle press or in a continuous working press (p=30 bar, T=200° C.) whereby either a resin impregnated backing paper or a resin layer applied in a liquid process on the back side is, also hardened.

Example 3

A complete resin impregnated decor paper (resin amount: 100 wt %) and resin impregnated overlay (paper weight 30 g/$m^2$, final weight: 150 g/$m^2$) is placed on a HDF board. Corundum as abrasion reducing means was in the resin formulation, which was used for impregnating the overlay. Recycling paper (paper weight 100 g/$m^2$; resin amount 120 wt %) is used as backing paper. The complete structure is compressed in a short cycle press at 30 bar and 200° C.

Example 4

A strand of HDF boards is coated continuously with an impregnating resin on the basis of melamine in drum application. 100 g melamine resin/$m^2$ (solid content: 60 wt %) are thereby applied. The impregnating resin formulation contains the usual additives as hardener, wetting and separation means.

The impregnating resin is pre-dried after the application by means of a convection dryer or an NIR in order to evaporate a part of the water. However, the drying process has only to be conducted to the point that the resin contains its stickiness or the possibility of penetration into a paper.

A dry decor paper (paper weight: 80 g/$m^2$) is unrolled from an unrolling device and is rolled into the resin still capable of flowing. Thereby it has to be guaranteed that no wrinkles or waviness arise in the paper by multiple drums arranged one after the other on the upper side.

Than the paper is pressed in a continuous working press onto the board pre-coated with melamine resin. Subsequently a mixture of melamine resin (solid content impregnating resin: 60 wt %), cellulose and corundum in an amount of 50-80 g impregnating resin/$m^2$ depending on the desired abrasion class is applied onto the decor paper also by drum application. The mixture is dried in a convection dryer or by near infrared. The moisture of the coating is about 6 wt % after the drying process.

Subsequently a resin impregnated overlay (paper grammage: 25 g/$m^2$, final weight: 100 g/$m^2$) is placed thereon. Thereafter the coating is hardened in a short cycle press or in a continuous working press (p=30 bar, T=200° C.) wherein on the back side either a resin impregnated backing paper or a resin layer applied by a liquid method is hardened.

The products of the examples 1 and 2, which were produced according to the method of the invention by using a partially impregnated decor paper, differ in respect to the product of the example 3, which was produced using a complete impregnated decor paper in that they have a significant better behavior regarding their storage time. A complete impregnated paper has to be processed within a few month. The partially impregnated papers are however still usable after one year.

Furthermore, when processing from roll to roll or from the roll less cutting and material loss occurs.

In respect to the product of example 4 produced with a dry decor paper it has to be noticed that a one-sided impregnation according to the invention can be significantly simpler carried out in an impregnation channel than the pressing of glue into the backside of a paper as in case of the dry décor paper. This is aggravated by the different parameter (density of the paper, pigment content and so on).

Furthermore also significantly more time is provided for the impregnation process in comparison to the pressing in what leaves the process less critical.

The invention claimed is:

1. A method for producing a board of wood based material including a support board and a decor paper disposed on the support board, the method comprising the steps of:

a) providing the decor paper, the decor paper having a decoration on a side thereof, b) applying at least one resin as an impregnating agent solely onto a side of the decor paper opposite from the decoration, wherein the amount of resin applied is between 30% and 70%, based on a paper weight of the decor paper, and wherein the impregnating agent used is a melamine-formaldehyde resin, a melamine-phenol-formaldehyde resin, a melamine-urea resin, a polyurethane resin or an acrylate resin having a solid content between 30% and 50%, c) providing the support board, d) applying at least one layer of impregnating resin to at least one side of the support board, and e) placing the side of the decor paper opposite from the decoration onto the at least one side of the support board provided with the at least one layer of the at least one impregnating resin, wherein the decor paper impregnated on the side opposite from the decor has a swelling in length in a range between 0.2% and 0.4% and a swelling in width in a range between 0.5% to 0.9%.

2. The method according to claim 1, wherein the decor paper impregnated on the side opposite from the decoration is dried to a moisture of 3-10 wt %.

3. The method according to claim 1, wherein the amount of liquid resin applied to the side of the decor paper opposite from the decoration is between 40 and 60% based on the paper weight of the decor paper.

4. The method according to claim 1, wherein the decor paper impregnated on the side opposite from the decor is rolled up before being placed onto the support board.

5. The method according to claim 1, wherein the decor paper impregnated on the side opposite from the decor is placed onto the support board immediately following the impregnation.

6. The method according to claim 1, wherein the impregnation agent applied to the decor paper comprises the solid content between 40% to 50%.

7. The method according to claim 1, wherein the impregnating resin applied to the at least one side of the support board is a melamine-formaldehyde-resin, melamine-phenol-formaldehyde resin, a melamine-urea resin, a polyurethane resin or an acrylate resin with a solid content between 55% to 80%.

8. The method according to claim 1, wherein following the placement of the decor paper onto the support board at least one further layer of a resin is applied.

9. The method according to claim 8, wherein the resin to be applied onto the decor paper further comprises natural and/or synthetic fibers, abrasion resistant particles and optionally further additives.

10. The method according to claim 8, wherein after an interim drying at least one further application of a mixture of liquid resin, natural and/or synthetic fibers, abrasion resistant particles and optionally further additives takes place or at least one overlay is applied.

11. The method according to claim 1, wherein after the placement of the decor paper impregnated on the side opposite from the decor onto the support board at least one resin impregnated overlay is applied.

12. The method according to claim 1, wherein at least one backing paper is applied to the opposite side of the support board, which is not provided with the decor paper.

13. The method according to claim 1, wherein the support board, the decor paper, and the impregnating resin are compressed.

14. The method according to claim 1, wherein the support board is made of a wood based material, a plastic material, or a mixture of wood based and plastic materials.

15. The method according to claim 2, wherein the decor paper impregnated on the side opposite from the decoration is dried to the moisture of 5-7%.

16. The method according to claim 2, wherein the decor paper impregnated on the side opposite from the decoration is dried to the moisture of 6 wt %.

17. The method according to claim 3, wherein the amount of liquid resin applied to the side of the decor paper opposite from the decoration is 50% based on the paper weight of the decor paper.

18. The method according to claim 6, wherein the impregnation agent applied to the decor paper comprises the solid content of 50%.

19. The method according to claim 7, wherein the impregnating resin applied to the at least one side of the support board comprises the solid content between 60% to 70%.

* * * * *